US011957197B2

(12) United States Patent
Xu

(10) Patent No.: US 11,957,197 B2
(45) Date of Patent: Apr. 16, 2024

(54) COMPOSITE ITEMS OF FOOTWEAR AND HANDWEAR

(71) Applicant: Shanghai Uniwise International Co Limited, Shanghai (CN)

(72) Inventor: Qian Xu, Shanghai (CN)

(73) Assignee: Shanghai Uniwise International Co Limited, Shanghai (CN)

( * ) Notice: Subject to any disclaimer, the term of this patent is extended or adjusted under 35 U.S.C. 154(b) by 0 days.

(21) Appl. No.: 18/125,481

(22) Filed: Mar. 23, 2023

(65) Prior Publication Data

US 2023/0225438 A1 Jul. 20, 2023

Related U.S. Application Data

(62) Division of application No. 17/397,095, filed on Aug. 9, 2021, now Pat. No. 11,638,452.

(30) Foreign Application Priority Data

Feb. 26, 2021 (CN) ..... 202110218842.4
Jun. 11, 2021 (CN) ..... 202110654097.8

(51) Int. Cl.
*A41D 31/102* (2019.01)
*A41B 7/00* (2006.01)
*A41D 19/00* (2006.01)

(52) U.S. Cl.
CPC ..... *A41D 31/102* (2019.02); *A41B 7/00* (2013.01); *A41D 19/0006* (2013.01); *A41D 19/0044* (2013.01)

(58) Field of Classification Search
CPC ..... A41D 31/102; A41D 19/0006; A41D 19/0044; A41D 19/01529; A41D 19/0082; A41B 7/00

(Continued)

(56) References Cited

U.S. PATENT DOCUMENTS 3,793,851 A 2/1974 Thorneburg
3,831,360 A 8/1974 Horvath (Continued)

FOREIGN PATENT DOCUMENTS

DE 20318966 U1 3/2004
GB 1317866 A 5/1973
TW 202211829 A 4/2022

OTHER PUBLICATIONS

Combined Search and Examination Report dated Nov. 22, 2013 in UK Application GB1317866.0.

(Continued)

*Primary Examiner* — Jameson D Collier
(74) *Attorney, Agent, or Firm* — Pearne & Gordon LLP

(57) ABSTRACT

A composite item of footwear and handwear having a main body to accommodate the hand/foot of a wearer of the item, the main body comprising an outer layer, an inner layer and a waterproof and breathable intermediate layer between the outer and inner layers, and an opening through which a foot/hand can be inserted, the opening defined by a cuff arrangement comprising a cuff region that comprises an end region of each of the inner and intermediate layers and a cuff inner portion of the outer layer that extends beyond the said end regions, the cuff arrangement further comprising a waterproof cuff band fixed to one or both of the cuff inner portion and end region of the inner layer to lie over and be fixed to the outside of the outer layer, the location at which the waterproof cuff band is fixed to the outer layer is at a distance from the opening that is greater than the distance between the opening and the location at which the waterproof cuff band is fixed to the cuff inner portion or end region of the inner layer.

31 Claims, 7 Drawing Sheets

(58) Field of Classification Search
USPC ..... 2/162, 165, 167
See application file for complete search history.

(56) References Cited

U.S. PATENT DOCUMENTS

| | | | | |
|---|---|---|---|---|
| 4,443,511 | A | 4/1984 | Worden et al. | |
| 4,967,494 | A | 11/1990 | Johnson | |
| 5,244,716 | A | 9/1993 | Thornton et al. | |
| 5,483,703 | A | 1/1996 | Williams | |
| 5,518,801 | A | 5/1996 | Chappell et al. | |
| 5,682,616 | A | 11/1997 | Pisano | |
| 6,134,717 | A | 10/2000 | Grilliot et al. | |
| 6,139,929 | A | 10/2000 | Hayton et al. | |
| 6,807,683 | B2 | 10/2004 | Williams | |
| 10,986,878 | B2 | 4/2021 | Xu | |
| 11,638,452 | B2 * | 5/2023 | Xu | A41D 19/0006 2/167 |
| 2002/0017358 | A1 | 2/2002 | Williams | |
| 2002/0120977 | A1 | 9/2002 | Smith | |
| 2002/0170653 | A1 | 11/2002 | Cole | |
| 2005/0028251 | A1 | 2/2005 | Walsh et al. | |
| 2005/0081571 | A1 | 4/2005 | Bhatnagar et al. | |
| 2011/0138522 | A1 | 6/2011 | Grilliot et al. | |
| 2016/0095381 | A1 | 4/2016 | Xu | |
| 2016/0332711 | A1 | 11/2016 | Harrington et al. | |
| 2022/0061462 | A1 | 3/2022 | Heidenfelder et al. | |

OTHER PUBLICATIONS

Examination Report dated May 6, 2014 in UK Application GB1317866.0.

Search Report issued in corresponding UK Patent Application No. GB2202189.3 dated Aug. 11, 2022, 1 page.

European Search Report issued in corresponding European Patent Application No. 22 15 7486 dated Jul. 18, 2022, 7 pages.

* cited by examiner

COMPOSITE ITEMS OF FOOTWEAR AND HANDWEAR

CROSS-REFERENCE TO RELATED APPLICATIONS

This application is a divisional of U.S. patent application Ser. No. 17/397,095, filed Aug. 9, 2021, which claims the benefit of Chinese Application Nos. 2021106540978, filed Jun. 11, 2021, and 2021102188424, filed Feb. 26, 2021, which are incorporated in their entirety by reference.

FIELD OF INVENTION

The present invention relates to composite items of footwear and handwear, and specifically but not exclusively to composite waterproof socks and gloves.

BACKGROUND

There are many circumstances and environments in which waterproof socks and gloves find utility, including use in certain outdoor interests and activities like walking, running, trekking, hiking, cycling, fishing, camping and gardening, as well as use in commercial and industrial environments where it is important or desirable to keep the wearer's feet and/or hands dry.

The opening or cuff area of known socks and gloves offers the potential for water to seep between the sock/glove and the leg/arm of the wearer and through the cuff area itself, thus compromising the ability of known socks and gloves to keep the hands and feet of a wearer dry.

It is an object of the present invention to provide items of footwear and handwear, in particular socks and gloves, that have a cuff arrangement that helps to seal the item against the wearer to help prevent the ingress of water between the item and the wearer, whilst providing a close-fitting and comfortable item of wear, and that has a construction that helps prevent the ingress of water through the cuff arrangement itself.

In the present specification the term 'sock' is used to refer to flexible and stretchable items of footwear, including such items to be worn between the foot and a boot or shoe, as well as other sock-like items of footwear such as over-shoes, flexible booties and the like.

In the present specification the term 'glove' is used to refer to flexible and stretchable items of handwear, in particular fingered gloves and mittens.

SUMMARY OF INVENTION

According to the present invention there is provided a composite item of footwear/handwear having a main body defining a volume to accommodate the hand/foot of a wearer of the item, the main body comprising an outer layer, an inner layer and a waterproof and breathable intermediate layer between the outer and inner layers, the main body having an opening through which a foot/hand can be inserted to be accommodated in the volume, the opening defined by a cuff arrangement comprising a cuff region of the main body that comprises an end region of each of the inner and intermediate layers and a cuff inner portion of the outer layer that extends beyond the said end regions, the cuff arrangement further comprising a waterproof cuff band that is fixed to one or both of the cuff inner portion of the outer layer and end region of the inner layer to extend over the inside and around the open end of the cuff inner portion and back over the outside of the cuff inner portion to lie over and fixed to the outside of the outer layer, the location at which the waterproof cuff band is fixed to the outer layer is at a distance from the opening that is greater than the distance between the opening and the location at which the waterproof cuff band is fixed to the cuff inner portion or end region of the inner layer.

The part of the waterproof cuff band that extends over the inside of the cuff inner portion is provided to fit comfortably against the leg, typically the ankle or calf of the leg of the wearer of the item when the item is one of footwear, or the wrist or forearm of the wearer of the item when the item is one of handwear, to provide a comfortable seal to help prevent the ingress of water between the cuff arrangement and the wearer's body.

The extension of the waterproof cuff over the inside and around the open end of the cuff inner portion and back over the outer surface with the location at which the waterproof cuff band is fixed to the outer layer being at a distance from the opening that is greater than the distance between the opening and the location at which the waterproof cuff band is fixed to the cuff inner portion or end region of the inner layer provides a cuff arrangement that is resistant to the ingress of water through the cuff arrangement itself, to the inside of the item as will be explained in more detail hereinafter.

The location at which the waterproof cuff band is fixed to the outer layer is between 10 and 40 millimetres further from the opening than the distance between the opening and the location at which the waterproof cuff band is fixed to the cuff inner portion or end region of the inner layer, to provide an area of overlap.

This degree of overlap has been shown to provide the cuff arrangement with favourable resistance to water ingressing through the cuff arrangement into the volume.

Preferably, the location at which the waterproof cuff band is fixed to the outer layer is between 20 and 40 millimetres further from the opening than is the location at which the waterproof cuff band is fixed to the cuff inner portion or end region of the inner layer.

This has been shown to provide favourable water resistance characteristics balanced with favourable design and comfort characteristics.

Preferably, the waterproof cuff band is fixed to the inner surface of the cuff inner portion and/or the end region of the inner layer.

This helps ensure the waterproof cuff band remains securely positioned around the inside of the cuff region.

Preferably, the waterproof cuff band is fixed to the inner surface of the cuff inner portion and/or the end region of the inner layer in a continuous band around the waterproof cuff band.

This helps ensure the waterproof cuff band remains securely in place all the way around the cuff region.

Preferably, the waterproof cuff band is fixed to the inner surface of the cuff inner portion and/or the end region of the inner layer by a continuous band of stitching.

This helps ensure the waterproof cuff band remains securely in place all the way around the cuff region and opening of the item and provides for relative ease of manufacture and comfort for the wearer.

Preferably, the waterproof cuff band is fixed to the inner surface of the cuff inner portion and/or the end region of the inner layer by a continuous band of adhesive.

Preferably the adhesive penetrates through the inner layer to seal against the intermediate layer when the waterproof cuff band is fixed to the end region of the inner layer.

This inhibits any water that finds its way inside the waterproof cuff band from wicking along the inner layer, past the location at which the waterproof cuff band is fixed to the end region of the inner layer and into the inside of the item.

The continuous band of adhesive may be provided as adhesive tape.

This helps ensure the waterproof cuff band remains securely in place all the way around the cuff region and opening of the item and also does not run the risk of compromising the waterproof character of the waterproof cuff band.

Preferably, the waterproof cuff band is fixed to the inner surface of the cuff inner portion and/or the end region of the inner layer by a continuous band of waterproof adhesive.

This helps maintain the integrity of the fixing, even in the event the adhesive is exposed to water.

Preferably, the waterproof cuff band is fixed to the inner surface of the cuff inner portion and/or the end region of the inner layer by continuous bands of both stitching and adhesive.

This can provide a more secure fixing of the waterproof cuff band to the inner surface of the cuff inner portion.

The waterproof cuff band may be fixed to the end region of the inner layer by stitching that extends through the inner layer only, the inner layer and the intermediate layer only, or the inner layer, the intermediate layer and the outer layer.

Preferably, the waterproof cuff band is fixed to the outer layer, which ensures the waterproof cuff band is held in place around the cuff region.

Preferably, the waterproof cuff band is fixed to the outer layer to lie generally flat over the outer layer.

This can help with the functioning and aesthetics of the item.

Preferably, the waterproof cuff band is fixed to the outer layer in a continuous band around the outer layer.

This helps ensure the waterproof cuff band remains securely in place all the way around the opening of the item and over the cuff region and helps to seal the waterproof cuff band to the outer layer.

Preferably, the waterproof cuff band is fixed to the outer layer by a continuous band of adhesive around the outer layer.

This helps ensure the waterproof cuff band remains securely in place all the way around the opening and cuff region of the item.

Preferably the adhesive penetrates through the outer layer to seal against the intermediate layer.

This seals the outer layer to the waterproof intermediate layer, thereby inhibiting water from wicking along the outer layer, past the intermediate layer and into the inside of the waterproof cuff band to the inner layer.

The continuous band of adhesive may be provided as adhesive tape.

Preferably, the waterproof cuff band is fixed to the outer layer by a continuous band of waterproof adhesive around and through the outer layer.

This helps maintain the integrity of the fixing, and inhibits ingress of water to the inside volume as a result of wicking through the outer layer, when the adhesive is exposed to water.

Stitching may be used to fix the waterproof cuff band to the outer layer.

The stitching may be provided in a continuous band around the outer layer.

The waterproof cuff band may be fixed to the outer layer in continuous bands of both adhesive and stitching around the outer layer.

This can provide a particularly secure and water-tight fixing of the waterproof cuff band to the outer layer.

Preferably, the waterproof cuff band comprises a resiliently stretchable waterproof material, stretchable to enable the waterproof cuff band to expand and contract as the open end expands and contracts to accommodate a foot/hand as it is inserted and removed from the volume.

Preferably, the waterproof cuff band comprises a stretchable waterproof polyurethane material.

Preferably, the outer layer comprises main body yarns and twisted elastic yarns woven throughout the main body yarns.

Preferably, the main body yarns comprise one or more of polyamide, cotton, modal, polyester.

Preferably, the inner layer comprises inner layer main body yarns of one or more of cotton, wool, acrylic, rayon, polyamide, polyester.

Preferably, one or more adhesives are used to fix the outer layer and the inner layer to the waterproof and breathable intermediate layer.

Preferably, the waterproof and breathable intermediate layer extends between the inner and outer layers with a corrugated structure in both weft X and warp Y directions.

Preferably, the waterproof and breathable intermediate layer is configured to be stretchable circumferentially and longitudinally.

Preferably, the adhesive(s) is/are provided on both inner and outer layers as discrete spots or islands of adhesive to fix the waterproof and breathable intermediate layer to each of and in between the inner and outer layers at discrete locations.

Preferably, in at least one region of the main body the discrete spots or islands of adhesive are spaced further apart from each other in one or both of the weft X and warp Y directions than elsewhere in the main body, thus giving that at least one region differential stretch characteristics in one or both of the weft X and warp Y directions than elsewhere in the main body.

DESCRIPTION OF DRAWINGS

Specific embodiments of the present invention will now be described by way of example only, with reference to the accompanying drawings in which.

DESCRIPTION FO THE SPECIFIC EMBODIMENTS

Figure 1:
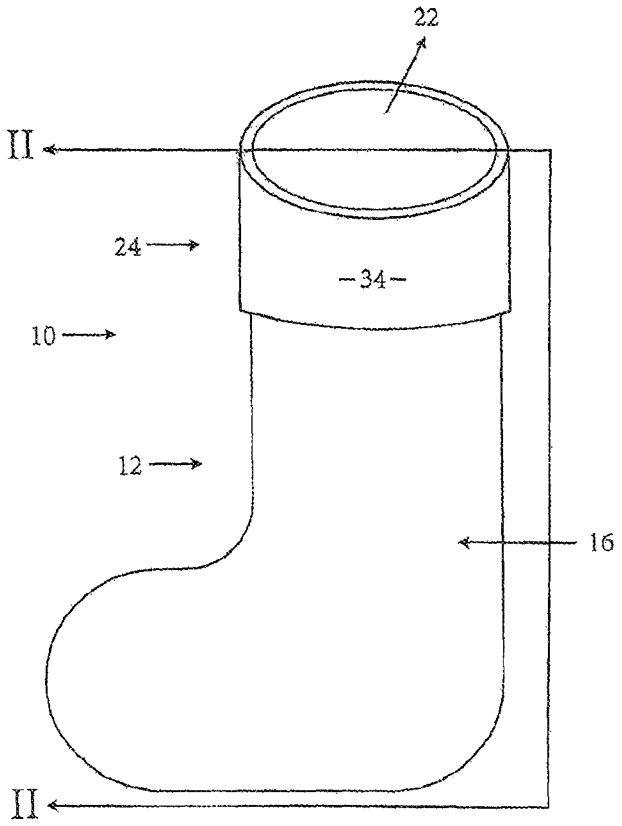
FIG. 1 is a diagrammatic perspective view of a composite item of footwear according to the present invention.

With reference to FIGS. 1 to 4, the present invention provides a composite item of footwear in the form of a sock 10 having a main body 12 defining a volume 14 to accommodate the foot of a wearer of the item 10, the main body 12 comprising an outer layer 16, an inner layer 18 and a waterproof and breathable intermediate layer 20 between the outer and inner layers 16, 18, the main body 12 having an opening 22 through which a foot/hand can be inserted to be accommodated in the volume 14. The opening 22 is defined by a cuff arrangement 24 comprising a cuff region 25 of the main body 12 that comprises an end region 28, 30 of each of the inner 18 and intermediate 20 layers and a cuff inner portion 32 of the outer layer 16 that extends beyond the said end regions 28, 30. The cuff arrangement 24 further comprises a waterproof cuff band 34 that is fixed to the cuff inner portion 32 of the outer layer 16 to extend over the inside 36 and around the open end 38 of the cuff inner portion 32 and back over the outside 40 of the outer layer 16, with the location L1 at which the waterproof cuff band 34 is fixed to the outer layer 16 being at a distance d1 from the opening 22 that is greater than the distance d2 between the opening 22 and the location L2 at which the waterproof cuff band 34 is fixed to the cuff inner portion 32.

In more detail, the present invention provides composite waterproof socks 10 that have a laminate structure in which the inner layer 18 comprises inner layer main body yarns of one or more of cotton, wool, acrylic, rayon, polyamide, polyester and/or any other suitable materials or blends of materials, particularly selected for comfort of the wearer and according to the intended use or purpose of the sock.

The outer layer 16 comprises main body yarns and twisted elastic yarns woven throughout or substantially throughout the main body yarns.

The main body yarns comprise one or more of polyamide, cotton, modal, polyester and/or any other suitable materials or blends of materials, particularly selected according to the intended purpose or use of the sock.

The twisted elastic yarns comprise spandex yarns or other suitable elastic yarns, and are typically incorporated at approximately 350 twists per metre.

The inner and outer layers 18, 16 are typically knitted, such as on a 13 gauges toe sock knitting machine. The outer layer 16 is typically knitted with a heel portion. The inner layer 18 can be knitted with or without a heel portion, depending upon the desired design and/or application of the sock 10.

The waterproof and breathable intermediate layer 20 comprises a polyurethane or other suitable waterproof breathable material and one or more adhesives 44 are used to fix the outer layer 16 to the outer surface of the waterproof intermediate layer 20 and to fix the inner layer 18 to the inner surface of the waterproof intermediate layer 20.

Suitable adhesives are heat-activated thermoplastic polyurethane (TPU) materials.

Figure 4:
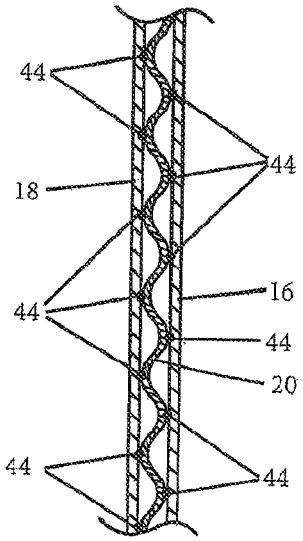
FIG. 4 is an enlarged cross-sectional view of the region IV of the composite item of footwear of FIG. 2.

As illustrated particularly in FIG. 4, the waterproof and breathable intermediate layer 20 is fixed between the inner and outer layers 18, 16 so that when the sock 10 is in a relaxed state, the waterproof and breathable intermediate layer 20 has a corrugated structure in both weft X and warp Y directions. This enables the waterproof and breathable intermediate layer 20 to extend both circumferentially and longitudinally as the inner and outer layers 18, 16 are stretched, enabling the sock 10 to stretch and contract as the sock 10 is fitted, worn and removed by a wearer.

The adhesive(s) 44 is/are provided on both the inner and outer layers 18, 16 as discrete spots or islands 44 of adhesive to fix the waterproof and breathable intermediate layer 20 to each of and in between the inner and outer layers 18, 16 such that when the inner and outer layers 18, 16 are in relaxed condition the waterproof and breathable intermediate layer 20 adopts the three-dimensional corrugated structure.

In certain embodiments, in at least one region of the main body 12 the discrete spots or islands 44 of adhesive are spaced further apart from each other in one or both of the weft X and warp Y directions than elsewhere in the main body 12, thus giving that at least one region a differential corrugated profile and thus differing stretch characteristics in one or both of the weft X and the warp Y directions than elsewhere in the main body 12. This enables the main body 12 to stretch circumferentially and longitudinally and to stretch to different extents in different regions, being more resistant to further stretch in the region where the spacings between the discrete dots or islands 44 of adhesive are smaller than elsewhere.

Such differential stretch characteristics can be designed or engineered into the overall composition of the socks 10 to provide improved comfort for wearers of the socks 10 of the present invention.

The cuff arrangement 24 provides for sealing of the opening or cuff of the sock 10 against the leg of the wearer. The precise part of the leg against which the sock 10 is designed to seal will in large part be determined by the intended utility or style of the sock 10, but socks 10 of the present invention would typically extend from the ankle to partway up the calf and shin of the wearer of the sock 10.

The cuff arrangement 24 also provides for resistance to water permeating through the structure of the cuff arrangement 24 and thus ingressing into the inside of the sock 10.

Figure 2:
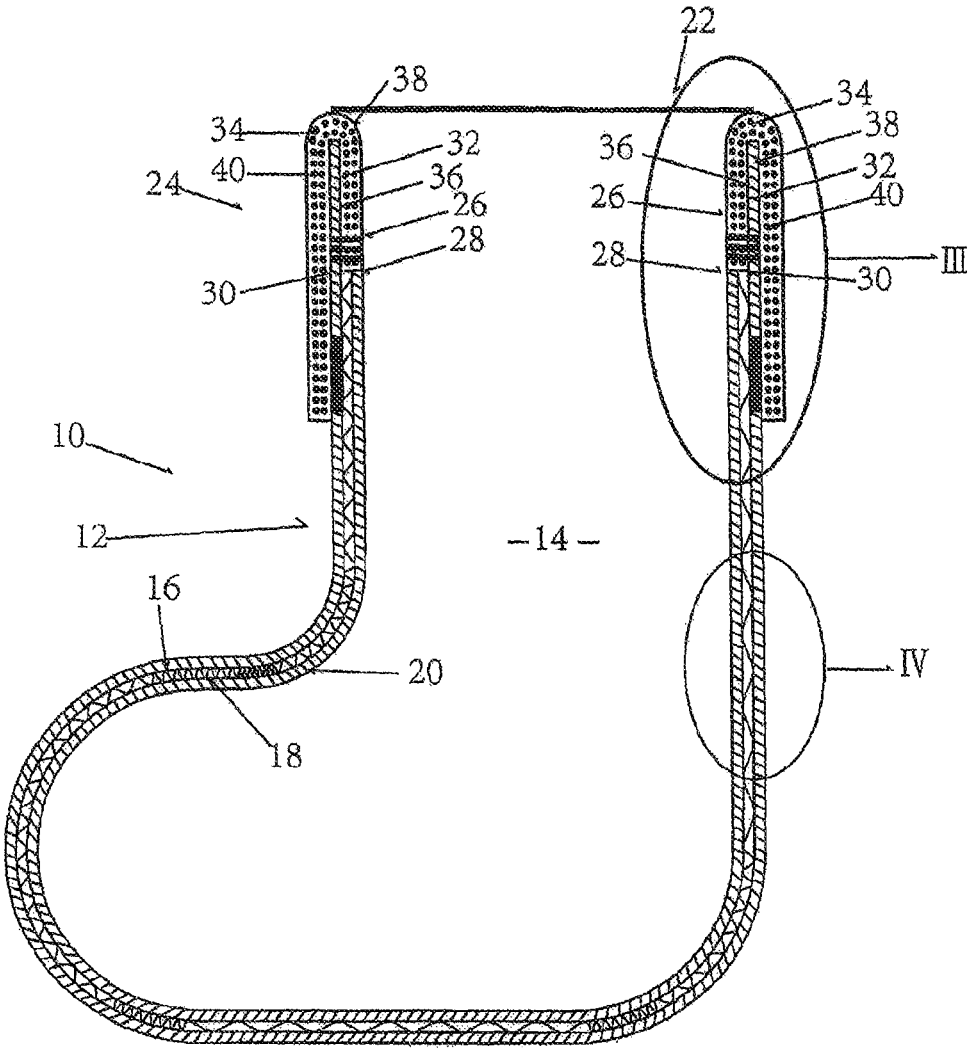
FIG. 2 is a diagrammatic cross-section of the composite item of footwear of FIG. 1 in the plane II-II.
Figure 3:
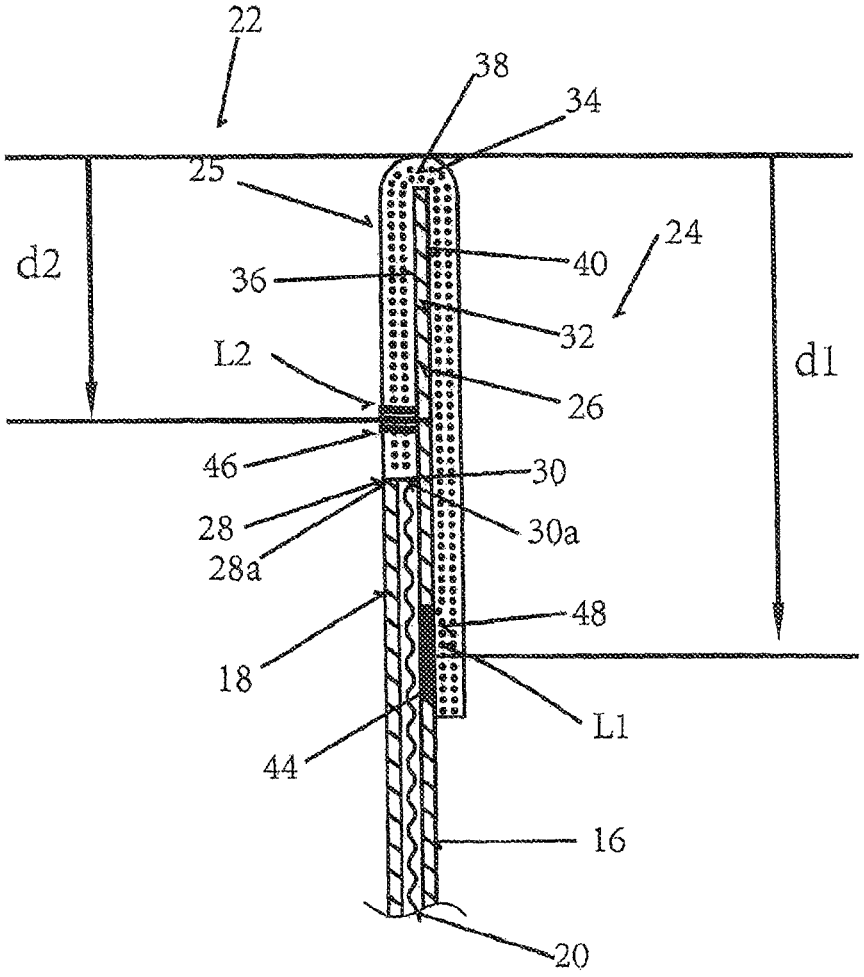
FIG. 3 is an enlarged view of the region III of the composite item of footwear of FIG. 2.

In the embodiment illustrated in FIGS. 2 and 3, the waterproof cuff band 34 extends from the open ends 28*a*, 30*a* of the end regions 28, 30 of the inner and intermediate layers 18, 20, where it generally abuts or is in close proximity to these open ends 28*a*, 30*a* and from there extends closely over the inside 36 of the cuff inner portion 32, around the open end 38 and back over the outside 40 of the cuff inner portion 32 to lie closely over, adjacent to the outside 40 of the outer layer 16.

The part of the waterproof cuff band 34 that extends over the inside of the cuff inner portion 32 is provided to fit comfortably against the leg, typically the ankle or calf of the leg of the wearer of the item when the item is one of footwear, or the wrist or forearm of the wearer of the item when the item is one of handwear, to provide a comfortable seal to help prevent the ingress of water between the cuff arrangement and the wearer's body.

In this embodiment the waterproof cuff band 34 is fixed to the cuff inner portion 32 only, and the location L2 at which it is fixed is at a shorter distance d2 from the opening 22 than the distance d1 of the location L1 at which the waterproof cuff band 34 is fixed to the outer layer 16.

This arrangement of fixing locations provides the cuff arrangement 24 with resistance to the ingress of water through the cuff arrangement 24 itself, to the inside of the sock 10 as will be explained in more detail hereinafter.

The location L1 at which the waterproof cuff band 34 is fixed to the outer layer 16 is also at a greater distance from the opening 22 than the ends 28*a*,30*a* of the inner and intermediate layers 18, 20 are distanced from the opening 22. This results in the ends 28*a*,30*a* being located between the location L1 at which the waterproof cuff band 34 is fixed to the outer layer 16 and location L2 whereat the waterproof cuff band 34 is fixed to the cuff inner portion 32, which configuration further enhances the resistance of the cuff arrangement 24 from the ingress of water therethrough.

In certain embodiments, the location L1 at which the waterproof cuff band 34 is fixed to the outer layer 16 is between 10 and 40 millimetres further from the opening 22 than the location L2 at which the waterproof cuff band 34 is fixed to the cuff inner portion 32. That is, d1 is between 10 and 40 millimetres greater than d2.

This differential has been shown to provide the cuff arrangement 24 with favourable resistance to water ingressing through the cuff arrangement 24 into the volume.

In further embodiments the location L1 at which the waterproof cuff band 34 is fixed to the outer layer 16 is between 20 and 40 millimetres further from the opening 22 than the location L2 at which the waterproof cuff band 34 is fixed to the cuff inner portion 32. That is, d1 is between 20 and 40 millimetres greater than d2.

This has been shown to provide favourable water resistance characteristics balanced with favourable design and comfort characteristics.

The waterproof cuff band 34 comprises resiliently stretchable waterproof material, stretchable to enable the waterproof cuff band 34 to expand and contract as the opening 22 expands and contracts to receive and release the foot of a person when it is inserted into and removed from the volume.

Typically, the waterproof cuff band 34 comprises a stretchable waterproof polyurethane material, although other suitable waterproof materials can be used.

The waterproof cuff band 34 is fixed to the inner surface 36 of the cuff inner portion 32 in a continuous, circumferential band around the waterproof cuff band 34.

In certain embodiments, like the one shown in FIG. 3, the waterproof cuff band 34 is fixed to the inner surface 36 of the cuff inner portion 32 by a continuous band of stitching 46 of thread.

In alternative embodiments, the waterproof cuff band 34 is fixed to the inner surface 36 of the cuff inner portion 32 by a continuous band of adhesive, and typically waterproof adhesive.

The adhesive can be provided as an adhesive tape.

In still further embodiments, the waterproof cuff band 34 is fixed to the inner surface 36 of the cuff inner portion 32 by a continuous band of both stitching 46 and adhesive.

The waterproof cuff band 34 is also fixed to the outer layer 16 and is fixed to lie generally flat on the outer surface 40 of the outer layer 16.

The location L1 at which the waterproof cuff band 34 is fixed to the outer layer 16 is at a greater distance from the opening 22 than are the ends 28*a*,30*a* of the inner and intermediate layers 18, 20. The ends 28*a*,30*a* are located between the location L1 at which the waterproof cuff band 34 is fixed to the outer layer 16 and location L2 at which the waterproof cuff band 34 is fixed to the cuff inner portion 32.

In preferred embodiments the waterproof cuff band 34 is fixed to the outer layer 16 by a continuous band of adhesive, most preferably waterproof adhesive 48 that penetrates the outer layer 16 to seal against the intermediate layer 20 This provides fixing and sealing of the waterproof cuff band 34 to, through and around the outer layer 16 in a continuous water-sealed manner that acts to prevent water from seeping in between the waterproof cuff band 34 and the waterproof intermediate layer 20 and from wicking from outside of the item along the outer layer 16, past location L1 to the end 30*a* of the intermediate layer 20 and beyond. This acts to prevent water from outside of the sock 10 wicking along the outer layer 16 to positions at which it could seep past the end 30*a* of the intermediate layer 20 and into the inside of the sock, such as the position at which the waterproof intermediate layer 20 ends 30*a* and the position at L2 where the stitching 46 might compromise the waterproof barrier of the waterproof cuff band 34 as it passes therethrough.

This ensures the waterproof cuff band 34 is secured and sealed against the intermediate layer over the outside of the area at which the waterproof cuff band 34 extends from the open ends 28, 30 of the inner layer and the intermediate layer 18, 20. In this area the intermediate layer 20 ends and so no longer provides a waterproof barrier through the main body in the cuff region 25, so there would be risk of water ingress through that area of the cuff region 25. This risk is addressed by fixing and sealing the waterproof cuff band 34 to the outer layer 16 at location L1 as described, so that the waterproof cuff band 34 lies over this area to provide a sealed, waterproof covering which acts to prevent water from wicking from the outside of the sock 10, along the outer layer 16, past the end 30*a* of the intermediate layer 20 and thus through the cuff region 25 to the inside of the sock 10.

In alternative embodiments, the waterproof cuff layer 34 may be fixed to the outer layer 16 with a continuous band of stitching of thread. In such embodiments, it is important that the stitching does not puncture the intermediate layer 20, otherwise this could compromise the waterproof structure of the cuff arrangement 24.

The stitching is such that it inhibits wicking of water from the outside of the sock 10, along the outer layer 16, past the end 30*a* of the intermediate layer 20 and thus through the cuff region 25 to the inside of the sock 10.

In certain embodiments the stitching is of waterproof thread and the stitching pattern such that it presents a barrier that inhibits wicking as aforesaid.

In certain embodiments, the waterproof cuff band 34 may be fixed to the outer layer 16 by both stitching and adhesive, as described above.

Figure 5:
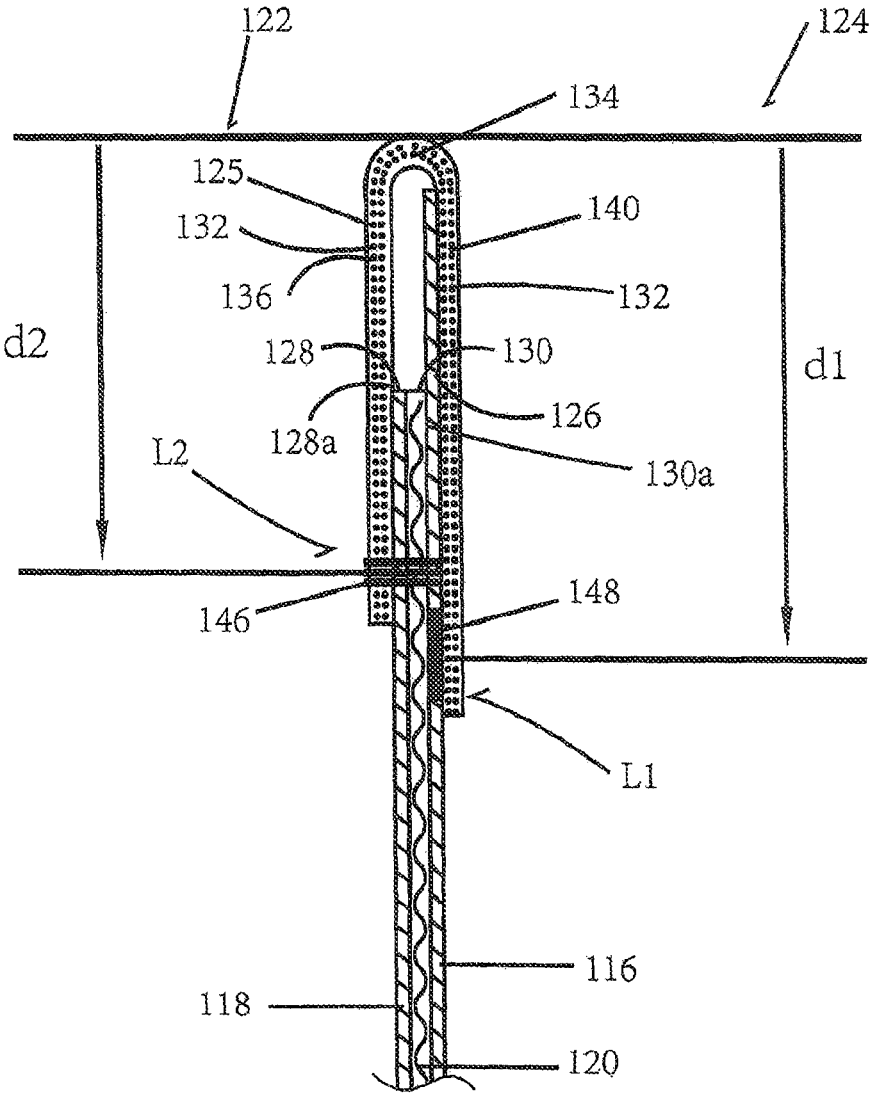
FIG. 5 is a view equivalent to the view of FIG. 3, but of a composite item of footwear of an alternative embodiment of the present invention.

FIG. 5 shows an equivalent view to the view of FIG. 3, but of an item of footwear according to an alternative embodiment of the present invention. This embodiment shares features of the embodiment shown in FIG. 3 and those features that are visible in FIG. 5 have been identified with the same reference numerals used in relation to the illustration in FIG. 3, but prefixed with the numeral 1.

In this embodiment the waterproof cuff 134 is fixed to and through the end region 128 of the inner layer 118 to extend in similar manner as described above, over the inside and around the open end 138 of the cuff inner portion 132 and back over the outside 140 of the cuff inner portion 132 to lie over and fixed to the outside 140 of the outer layer 116, with the location L1 at which the waterproof cuff band 134 is fixed to the outer layer 116 at a distance d1 from the opening that is greater than the distance d2 between the opening 122 and the location L2 at which the waterproof cuff band 134 is fixed to the end region 128 of the inner layer 118.

As illustrated in FIG. 5, the waterproof cuff band 34 is fixed by stitching 146 that extends through the waterproof cuff band 134, through the end region 128 of the inner layer 118, through the end region 130 of the waterproof intermediate layer 120, and through the outer layer 116.

Although in this embodiment the stitching 146 may to some degree compromise the waterproof barrier provided by the waterproof intermediate layer 120, the location L2 of the stitching 146 being closer to the opening 122 than the location L1 at which the waterproof cuff band 134 is fixed to the outer layer 116 by the continuous band of adhesive penetrating through the outer layer 116 to seal against the intermediate layer 120 and/or the stitching 148 as described above means that this does not compromise the water impermeable nature of the cuff arrangement 24.

In other embodiments the stitching of the waterproof cuff band 134 at location L2 could extend through the inner layer 118 only, or through the inner layer 118 and the waterproof intermediate layer 120 only.

Figure 7:
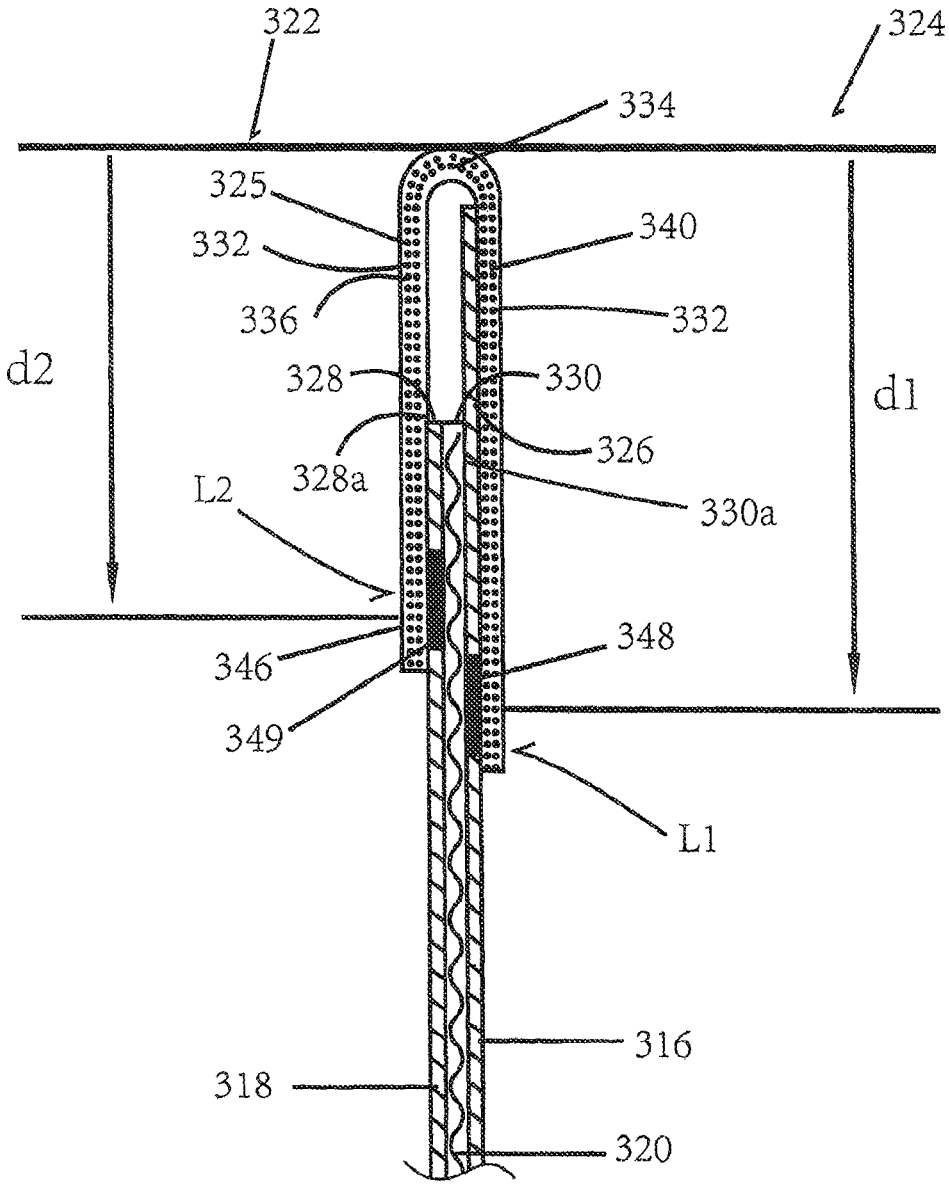
FIG. 7 is a diagrammatic view equivalent to that of FIG. 5, but of a composite item of handwear according to a still further embodiment of the present invention

FIG. 7 shows an equivalent view to the view of FIG. 5, but of an item of footwear according to a further alternative embodiment of the present invention. This embodiment shares features of the embodiment shown in FIG. 5 and those features that are visible in FIG. 7 have been identified with the same reference numerals used in relation to the illustration in FIG. 5, but prefixed with the numeral 3.

In this embodiment adhesive 349 is used to fix the waterproof cuff band 334 to the inner layer 318 instead of or in addition to stitching.

The adhesive 349 is a continuous band, most preferably of waterproof adhesive, that extends continuously circumferentially around the end region penetrating the inner layer 318 to seal against the intermediate layer 320.

This provides fixing and sealing of the waterproof cuff band 334 to and around the inner layer 318 in a continuous water-sealed manner that acts to prevent any water that's found its way inside the waterproof cuff band 334 (such as in the event the outer seal 348 has been compromised or damaged) from wicking from the inside of the waterproof cuff band 334, through the end 328*a* and along the inner layer 318, past location L2, and thus to the inside of the sock 310.

Figure 6:
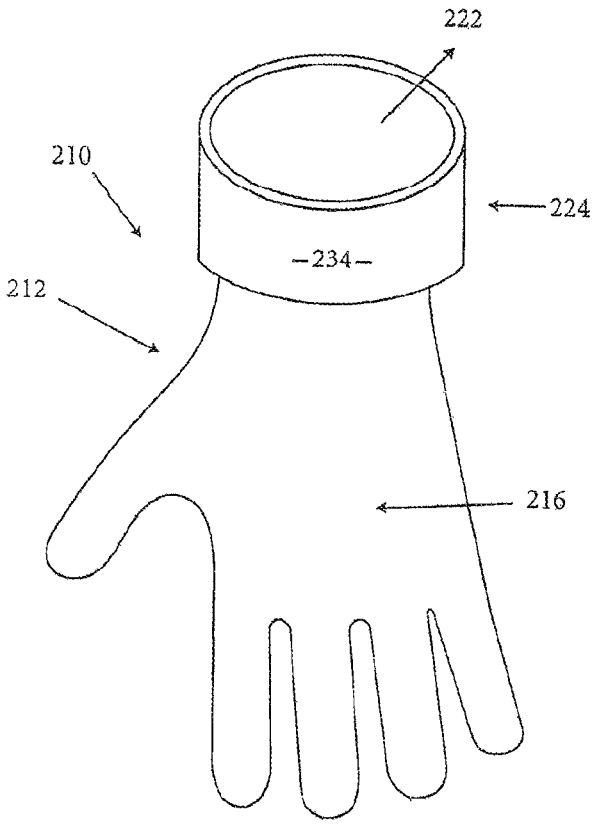
FIG. 6 is a diagrammatic perspective view of a composite item of handwear according to a further embodiment of the present invention.

FIG. 6 is a diagrammatic perspective view of an item of handwear 210, in the form of a glove, which has the same structural features of the item of footwear (sock) 10 described above. Visible features have therefore been identified with the same reference numerals used in relation to the illustrations of the sock 10, but prefixed with the numeral '2'.

It will be appreciated that the structure and configuration of the cuff arrangement 24 of the items of the present invention as described above in the context of footwear find the same utility in items of handwear, providing for a cuff arrangement 24 that resists the ingress of water between the open end of the glove and the wrist/arm of the wearer of the glove and the ingress of water through the cuff arrangement 24 itself.

Various modifications may be made without departing from the spirit or scope of the present invention. The present document discloses specific embodiments of the present invention, but is not limiting on the scope of the invention.

A plurality of bands of one or both of adhesive and/or stitching can be provided to fix the waterproof cuff band to one or both of the cuff inner portion of the outer layer and end region of the inner layer and the outside of the outer layer.

Whilst endeavouring in the foregoing specification to draw attention to those features of the invention believed to be of particular importance, it should be understood that the applicant claims protection in respect of any patentable feature or combination of features hereinbefore referred to and/or shown in the drawings, whether or not particular emphasis has been placed thereon.

The invention claimed is:

1. A composite item of handwear comprising a main body defining a volume to accommodate a hand of a wearer of the item of handwear, the main body comprising an outer layer, an inner layer and a waterproof and breathable intermediate layer between the outer and inner layers, the main body having an opening through which the hand can be inserted to be accommodated in the volume, the opening defined by a cuff arrangement comprising a cuff region of the main body that comprises an end region of each of the inner and intermediate layers and a cuff inner portion of the outer layer that extends beyond the end regions, the cuff arrangement further comprising a waterproof cuff band that is fixed to one or both of the cuff inner portion of the outer layer and the end region of the inner layer to extend over an inside and around the open end of the cuff inner portion and back over an outside of the cuff inner portion to lie over and to be fixed to an outside of the outer layer, a location at which the waterproof cuff band is fixed to the outer layer is at a distance from the opening that is greater than the distance between the opening and a location at which the waterproof cuff band is fixed to the cuff inner portion or the end region of the inner layer.

2. The composite item of handwear as claimed in claim 1, in which the location at which the waterproof cuff band is fixed to the outer layer is between 10 and 40 millimeters further from the opening than the distance between the opening and the location at which the waterproof cuff band is fixed to the cuff inner portion or the end region of the inner layer, to provide an area of overlap.

3. The composite item of handwear as claimed in claim 2, in which the location at which the waterproof cuff band is fixed to the outer layer is between 20 and 40 millimeters further from the opening than the distance between the opening and the location at which the waterproof cuff band is fixed to the cuff inner portion or the end region of the inner layer.

4. The composite item of handwear as claimed in claim 1, in which the waterproof cuff band is fixed to an inner surface of the cuff inner portion and/or to the end region of the inner layer.

5. The composite item of handwear as claimed in claim 4, in which the waterproof cuff band is fixed to the inner surface of the cuff inner portion and/or to the end region of the inner layer in a continuous band around the waterproof cuff band.

6. The composite item of handwear as claimed in claim 5, in which the waterproof cuff band is fixed to the inner surface of the cuff inner portion and/or to the end region of the inner layer by a continuous band of stitching.

7. The composite item of handwear as claimed in claim 6, in which the waterproof cuff band is fixed to the inner surface of the cuff inner portion and/or to the end region of the inner layer by continuous bands of both stitching and adhesive.

8. The composite item of handwear as claimed in claim 6, in which the waterproof cuff band is fixed to the end region of the inner layer by stitching that extends through (i) the inner layer only, (ii) the inner layer and the intermediate layer only, or (iii) the inner layer, the intermediate layer and the outer layer.

9. The composite item of handwear as claimed in claim 5, in which the waterproof cuff band is fixed to the inner surface of the cuff inner portion and/or to the end region of the inner layer by a continuous band of adhesive.

10. The composite item of handwear as claimed in claim 9, in which the continuous band of adhesive penetrates through the inner layer to seal against the intermediate layer when the waterproof cuff band is fixed to the end region of the inner layer.

11. The composite item of handwear as claimed in claim 9, in which the waterproof cuff band is fixed to the inner surface of the cuff inner portion and/or to the end region of the inner layer by a continuous band of adhesive tape.

12. The composite item of handwear as claimed in claim 9, in which the waterproof cuff band is fixed to the inner surface of the cuff inner portion and/or to the end region of the inner layer by a continuous band of waterproof adhesive.

13. The composite item of handwear as claimed in claim 1, in which the waterproof cuff band is fixed to the outer layer.

14. The composite item of handwear as claimed in claim 13, in which the waterproof cuff band is fixed to the outer layer to lie generally flat over the outer layer.

15. The composite item of handwear as claimed in claim 13, in which the waterproof cuff band is fixed to the outer layer in a continuous band around the outer layer.

16. The composite item of handwear as claimed in claim 15, in which the waterproof cuff band is fixed to the outer layer in a continuous band of stitching around the outer layer.

17. The composite item of handwear as claimed in claim 16, in which the waterproof cuff band is fixed to the outer layer in continuous bands of both adhesive and stitching around the outer layer.

18. The composite item of handwear as claimed in claim 15, in which the waterproof cuff band is fixed to the outer layer in a continuous band of adhesive around the outer layer.

19. The composite item of handwear as claimed in claim 18, in which the waterproof cuff band is fixed to the outer layer in a continuous band of adhesive tape around the outer layer.

20. The composite item of handwear as claimed in claim 18, in which the adhesive penetrates through the outer layer to seal against the intermediate layer.

21. The composite item of handwear as claimed in claim 18, in which the waterproof cuff band is fixed to the outer layer in a continuous band of waterproof adhesive around the outer layer.

22. The composite item of handwear as claimed in claim 1, in which the waterproof cuff band comprises a stretchable waterproof material to enable the waterproof cuff band to expand and contract as the open end expands and contracts as the hand is inserted and removed from the volume.

23. The composite item of handwear as claimed in claim 22, in which the waterproof cuff band comprises a stretchable waterproof polyurethane material.

24. The composite item of handwear as claimed in claim 1, in which the outer layer comprises main body yarns and twisted elastic yarns woven throughout the main body yarns.

25. The composite item of handwear as claimed in claim 24, in which the main body yarns comprise one or more of polyamide, cotton, modal, or polyester.

26. The composite item of handwear as claimed in claim 1, in which the inner layer comprises inner layer main body yarns of one or more of cotton, wool, acrylic, rayon, polyamide, or polyester.

27. The composite item of handwear as claimed in claim 1, in which one or more adhesives are used to join the outer layer, the inner layer, and the waterproof and breathable intermediate layer.

28. The composite item of handwear as claimed in claim 27, in which the one or more adhesives are provided on both inner and outer layers as discrete spots or islands of adhesive to fix the waterproof and breathable intermediate layer to each of and in between the inner and outer layers.

29. The composite item of handwear as claimed in claim 28, in which in at least one region of the main body the discrete spots or islands of adhesive are spaced further apart from each other in one or both of the weft X and warp Y directions than elsewhere in the main body, thus giving said at least one region differential stretch characteristics in one or both of the weft X and warp Y directions than elsewhere in the main body.

30. The composite item of handwear as claimed in claim 1, in which the waterproof and breathable intermediate layer extends between the inner and outer layers with a corrugated structure in both weft X and warp Y directions.

31. The composite item of handwear as claimed in claim 30, in which the waterproof and breathable intermediate layer is configured to be stretchable circumferentially and longitudinally.

* * * * *